US011162195B2

(12) United States Patent
Xu

(10) Patent No.: US 11,162,195 B2
(45) Date of Patent: Nov. 2, 2021

(54) PROTECTIVE TEXTILE WITH TUNGSTEN AND MANUFACTURING METHOD THEREOF

(71) Applicant: Rui Ping Xu, San Gabriel, CA (US)

(72) Inventor: Rui Ping Xu, San Gabriel, CA (US)

( * ) Notice: Subject to any disclaimer, the term of this patent is extended or adjusted under 35 U.S.C. 154(b) by 308 days.

(21) Appl. No.: 16/407,053

(22) Filed: May 8, 2019

(65) Prior Publication Data

US 2020/0354861 A1 Nov. 12, 2020

(51) Int. Cl.

| | |
|---|---|
| ***D02G 3/12*** | (2006.01) |
| ***D02G 3/38*** | (2006.01) |
| ***D02G 3/44*** | (2006.01) |
| *A41D 19/015* | (2006.01) |

(52) U.S. Cl.

CPC ..... *D02G 3/12* (2013.01); *D02G 3/38* (2013.01); *D02G 3/44* (2013.01); *A41D 19/01505* (2013.01); *A41D 2500/20* (2013.01); *D10B 2101/20* (2013.01); *D10B 2321/021* (2013.01); *D10B 2331/021* (2013.01); *D10B 2331/04* (2013.01); *D10B 2331/06* (2013.01); *D10B 2331/12* (2013.01)

(58) Field of Classification Search

CPC ... D02G 3/12; D02G 3/38; D02G 3/44; D04B 1/28

See application file for complete search history.

(56) References Cited

U.S. PATENT DOCUMENTS

| | | | | |
|---|---|---|---|---|
| 3,503,200 A * | 3/1970 | Quirk | D02G 3/12 57/311 |
| 2017/0350044 A1* | 12/2017 | Sugita | D04B 1/28 |
| 2020/0199790 A1* | 6/2020 | Hayashi | D02G 3/36 |
| 2021/0071323 A1* | 3/2021 | Hu | D02G 3/047 |

FOREIGN PATENT DOCUMENTS

| | | | |
|---|---|---|---|
| GB | 2449483 A * | 11/2008 | D04B 1/28 |
| JP | 2019015007 A * | 1/2019 | G06Q 20/3552 |

* cited by examiner

*Primary Examiner* — Tajash D Patel

(74) *Attorney, Agent, or Firm* — Che-Yang Chen; Law Offices of Michael Chen

(57) ABSTRACT

In one aspect, a method of manufacturing a protective textile may include steps of (a) twisting a first yarn with a tungsten filament; and (b) using a second yarn to cover the yarn-tungsten product generated in step (a). The yarn generated in step (b) is further twisted with an elastic spandex. In one embodiment, the first yarn is selected from a group of Nylon, Polyethylene Terephthalate (PET), cotton yarn, bamboo fiber and Tencel. In another embodiment, a Polyethylene (PE) fiber is the second yarn, and the third yarn may include Nylon, PET or PE. The protective textile is advantageous because it is light, thin, soft and highly cut resistant. Also, it has great electrical conductivity and chemical stability, and it is not easy to deform after washing.

11 Claims, 3 Drawing Sheets

PROTECTIVE TEXTILE WITH TUNGSTEN AND MANUFACTURING METHOD THEREOF

FIELD OF THE INVENTION

The present invention relates to a yarn and a yarn forming process thereof, and more particularly to a protective textile produced by using the yarn and a tungsten wire and a manufacturing method of the protective textile.

BACKGROUND OF THE INVENTION

Cut resistant gloves are functional gloves. To achieve the goal of cut resistant, the thickness of current cut resistant gloves has to be increased. However, the user experience is adversely affected by the thickened gloves because conventional cut resistant gloves are heavy, stiff and hard to bend. Therefore, there remains a need for a new and improved protective textile and the manufacturing method thereof to overcome the problems stated above.

SUMMARY OF THE INVENTION

It is an object of the present invention to provide a protective textile that is light, thin, soft and highly cut resistant.

It is another object of the present invention to provide a protective textile having great electrical conductivity and chemical stability, and it is not easy to deform after washing.

It is a further object of the present invention to provide a protective textile that can reach level A6 under ASTM (American Society for Testing and Materials) standard.

In one aspect, a method of manufacturing a protective textile may include steps of (a) twisting a first yarn with two or more tungsten filaments; and (b) using a second yarn to cover the yarn-tungsten product generated in step (a). For step (a), in one embodiment, the first yarn is selected from a group of Nylon, Polyethylene Terephthalate (PET), cotton yarn, bamboo fiber and Tencel. The line density of the first yarn is 40 to 140 D. In another embodiment, the diameter of the tungsten filament is selected from a group of 0.01 mm, 0.015 mm, 0.02 mm, 0.025 mm and 0.03 mm. In a further embodiment, the degree of twist is 400-700 twists/meter for the first yarn and tungsten filament, wherein the tungsten filament is 35 to 75% and the first yarn is 25 to 65%.

For step (b), in one embodiment, a Polyethylene (PE) fiber is used to cover the yarn generated in step (a), and the degree of twist is 120-280 twists/meter, wherein the tungsten filament is about 35 to 65% and PE fiber is about 35-65%. The molecular weight of the PE fiber is 10 to 500 W, and the line density of the protective textile is 50 to 400 D. In another embodiment, the line density of the PE fiber is selected from a group of 50 D, 100 D, 150 D, 200 D, 300 D or 400 D.

In a further embodiment, the yarn generated in step (b) is further twisted with an elastic spandex using the technique of double yarn feeders (U2) to generate a cut resistant protective textile in the present invention, wherein the tungsten is 60 to 80%, spandex is 20 to 40%. The elastic spandex can be a third yarn covering the spandex. The third yarn may include Nylon, PET or PE. In one embodiment, the elastic spandex can be made by spandex with the line density of 20 to 100 D and the third yarn with the line density of 50-200 D, and the degree of twist is 180 to 580 twists/meter. The tension ratio of the elastic spandex is 1.5 to 2.4.

Comparing with conventional protective textiles, the present invention is advantageous because tungsten is used as raw material with the hardness of 9, which is only second to diamond, the hardest material in the world. The protective textile including tungsten in the present invention has high hardness but is thin and light. Also, the manufacturing costs can be significantly lowered if the protective textile is made in China, which produces significant amount of tungsten.

Furthermore, two or more tungsten filaments (e.g. 0.02 mm) can be used in the protective textile instead of one (e.g. 0.03 mm) since the sectional surface is reduced and the softness of the protective textile can be increased.

It is important to note that the protective textile in the present invention is light, thin, soft and highly cut resistant. It also has great electrical conductivity and chemical stability, and it is not easy to bend and deform after washing. The protective textile in the present invention can reach level A6 under ASTM (American Society for Testing and Materials) standard, European standard ISO level F or above, and European Union standard EN388 of wear resistance (level 4), cut resistance (level 5), tear resistance (level 4) and puncture prevention (level 4).

DETAILED DESCRIPTION OF THE INVENTION

Figure 2:
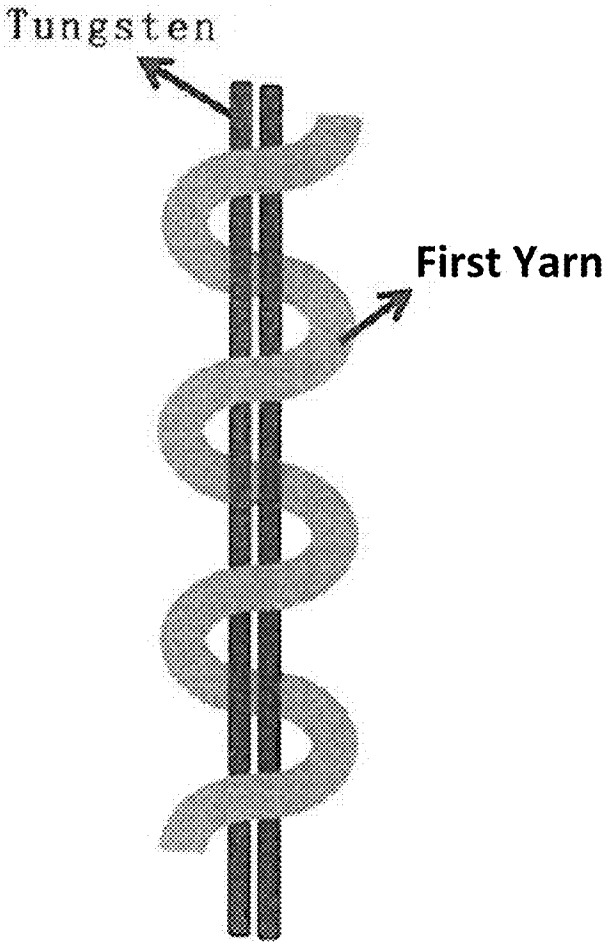
FIGS. 1 and 2 are schematic views of two or more tungsten filaments twisted with the first yarn in the present invention.
Figure 1:
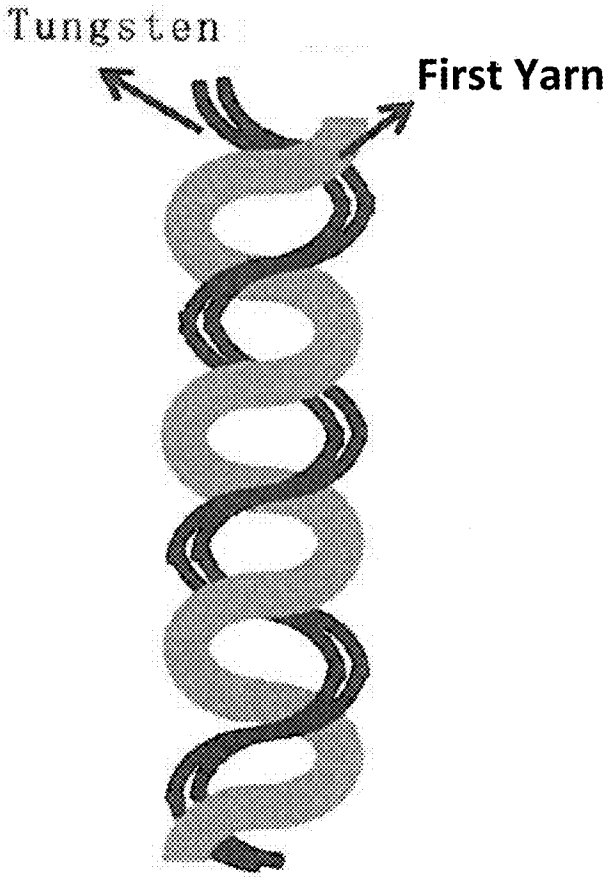
Figure 4:
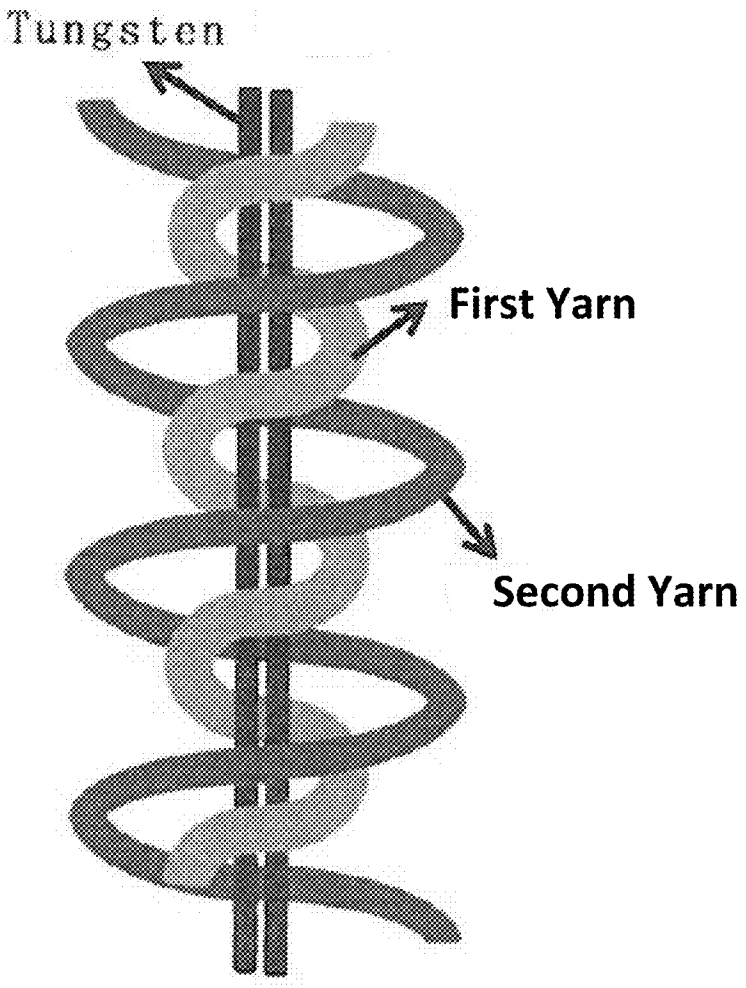
FIGS. 3 and 4 are schematic views of two or more tungsten filaments twisted with the first yarn and the second yarn in the present invention.
Figure 3:
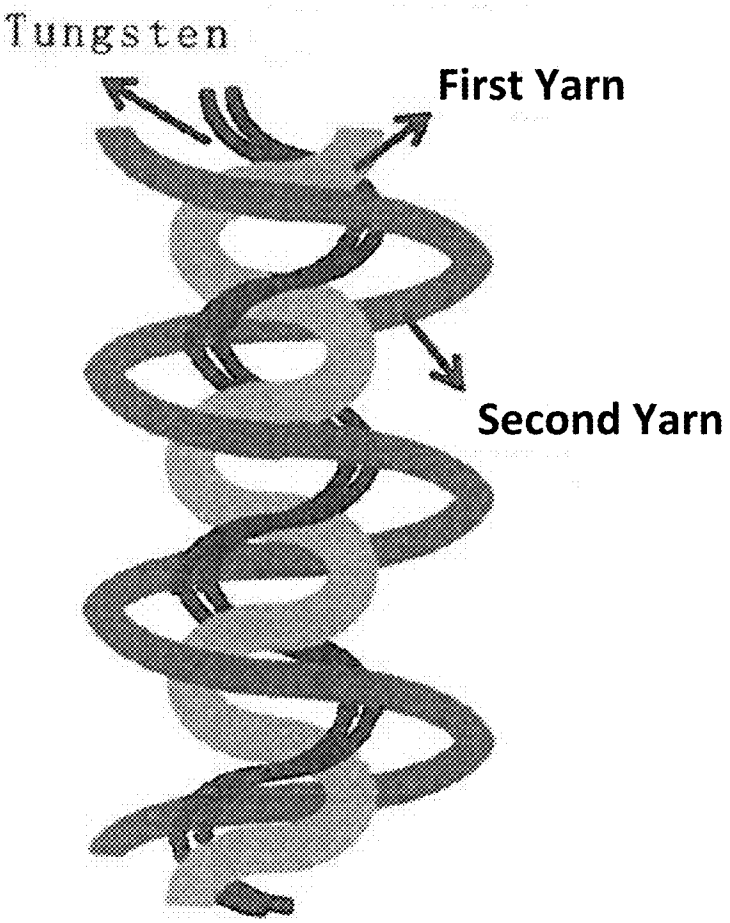
Figure 5:
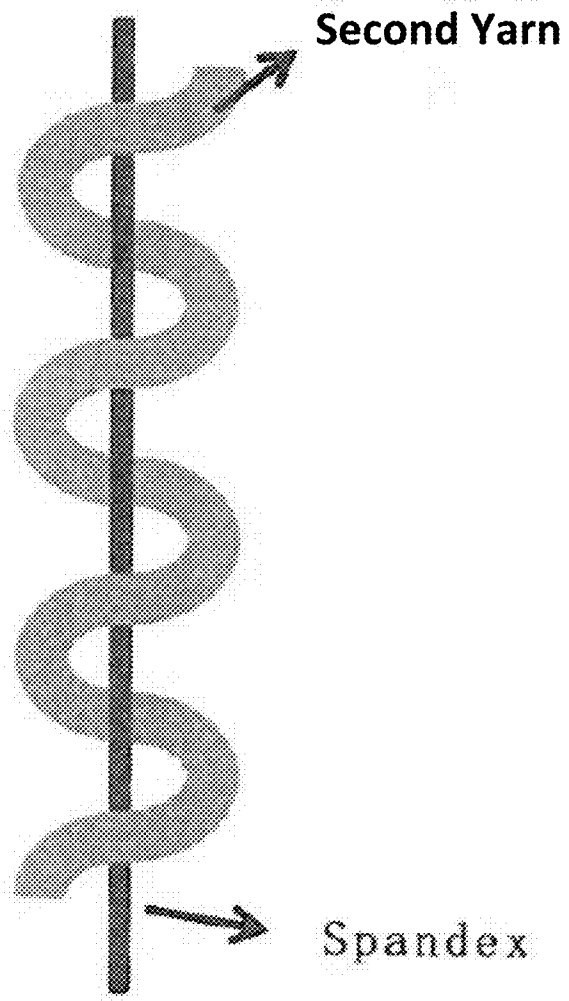
FIG. 5 illustrates a schematic view of an elastic spandex twisted with the yarn generated in FIGS. 3 and 4 in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

In one aspect, a method of manufacturing a protective textile may include steps of (a) twisting a first yarn with two or more tungsten filaments; and (b) using a second yarn to cover the yarn-tungsten product generated in step (a). For step (a), in one embodiment, the first yarn is selected from a group of Nylon, Polyethylene Terephthalate (PET), cotton yarn, bamboo fiber and Tencel. The line density of the first yarn is 40 to 140 D. In another embodiment, the diameter of the tungsten filament is selected from a group of 0.01 mm, 0.015 mm, 0.02 mm, 0.025 mm and 0.03 mm. In a further embodiment, the degree of twist is 400-700 twists/meter for the first yarn and tungsten filament, wherein the tungsten filament is 35 to 75% and the first yarn is 25 to 65%. In still a further embodiment, the line density of Nylon is selected from a group of 40 D, 50 D, 70 D, 100 D and 140 D.

For step (b), in one embodiment, a Polyethylene (PE) fiber is the second yarn used to cover the yarn generated in step (a), and the degree of twist is 120-280 twists/meter, wherein the tungsten filament is about 35 to 65% and PE fiber is about 35-65%. The molecular weight of the PE fiber is 10 to 500 W, and the line density of the protective textile is 50 to 400 D. In another embodiment, the line density of the PE fiber is selected from a group of 50 D, 100 D, 10 D, 200 D, 300 D or 400 D.

In a further embodiment, the yarn generated in step (b) is further twisted with an elastic spandex using the technique of double yarn feeders (U2) to generate a cut resistant protective textile in the present invention, wherein the tungsten is 60 to 80%, spandex is 20 to 40%. The elastic spandex can be a third yarn covering the spandex. The third yarn may include Nylon, PET or PE. In one embodiment, the elastic spandex can be made by spandex with the line density of 20 to 100 D and the third yarn with the line density of 50-200 D, and the degree of twist is 180 to 580 twists/meter. The tension ratio of the elastic spandex is 1.5 to 2.4.

Table I shows test results of sixteen samples of the protective textiles in the present invention, wherein the first yarn in samples 1 to 3 and samples 6 to 9 is Nylon, the first yarn in samples 4 to 5 and sample 10 to 13 is PET, and the first yarn in samples 14 to 16 is cotton yarn. Also, third yarn in samples 1 to 3 and samples 6 to 9 is Nylon, the third yarn in samples 4 to 5 and sample 10 to 13 is PET, and third yarn in samples 14 to 16 is PE.

Comparing with conventional protective textiles, the present invention is advantageous because tungsten is used as raw material with the hardness of 9, which is only second to diamond, the hardest material in the world. The protective textile including tungsten in the present invention has high hardness but is thin and light. Also, the manufacturing costs can be significantly lowered if the protective textile is made in China, which produces significant amount of tungsten.

Furthermore, two or more tungsten filaments (e.g. 0.02 mm) can be used in the protective textile instead of one (e.g. 0.03 mm) since the sectional surface is reduced and the softness of the protective textile can be increased.

It is noted that usually "tungsten" means the tungsten metal of 99.95 to 99.999% purity. In the present invention, the tungsten with the purity of 99.95% is used, which may include a small amount of other metals such as Si, Al, K, etc. The tungsten wire with 99.95% purity is also called "anti-sagging" tungsten wire. The element K in the anti-sagging tungsten wire plays an important role to interlock the internal structure of the tungsten to increase its capability of resisting high temperature.

It is important to note that the protective textile in the present invention is light, thin, soft and highly cut resistant. It also has great electrical conductivity and chemical stability, and it is not easy to deform after washing. The protective textile in the present invention can reach level A6 under ASTM (American Society for Testing and Materials) standard, European standard ISO level F or above, and European Union standard EN388 of wear resistance (level 4), cut resistance (level 5), tear resistance (level 4) and puncture prevention (level 4).

Having described the invention by the description and illustrations above, it should be understood that these are exemplary of the invention and are not to be considered as limiting. Accordingly, the invention is not to be considered as limited by the foregoing description, but includes any equivalent.

TABLE I

| | Diameter of Tungsten (mm) | Thickness of Yarn I (D) | Thickness of PE (D) | Thickness of Spandex (D) | Thickness of Yarn III (D) | Weight (g/unit) | Cut Resistance (ASTM) |
|---|---|---|---|---|---|---|---|
| Sample 1 | 0.006 | 70 | 50 | 20 | 100 | 13.5 | A4 |
| Sample 2 | 0.01 | 30 | 100 | 30 | 200 | 14.5 | A4 |
| Sample 3 | 0.015 | 70 | 100 | 140 | 100 | 15 | A4 |
| Sample 4 | 0.015 | 100 | 150 | 40 | 250 | 15.5 | A5 |
| Sample 5 | 0.015 | 100 | 200 | 70 | 250 | 16 | A5 |
| Sample 6 | 0.02 | 50 | 100 | 20 | 70 | 16.8 | A6 |
| Sample 7 | 0.02 | 70 | 150 | 40 | 100 | 17 | A6 |
| Sample 8 | 0.02 | 100 | 200 | 30 | 70 | 17.8 | A7 |
| Sample 9 | 0.02 | 70 | 200 | 20 | 140 | 18.8 | A7 |
| Sample 10 | 0.0025 | 70 | 150 | 30 | 100 | 18 | A6 |

TABLE I-continued

| | Diameter of Tungsten (mm) | Thickness of Yarn I (D) | Thickness of PE (D) | Thickness of Spandex (D) | Thickness of Yarn III (D) | Weight (g/unit) | Cut Resistance (ASTM) |
|---|---|---|---|---|---|---|---|
| Sample 11 | 0.0025 | 100 | 200 | 40 | 70 | 19 | A6 |
| Sample 12 | 0.0025 | 140 | 200 | 70 | 100 | 19 | A7 |
| Sample 13 | 0.03 | 140 | 200 | 40 | 140 | 19 | A6 |
| Sample 14 | 0.03 | 70 | 200 | 40 | 70 | 19.2 | A6 |
| Sample 15 | 0.03 | 100 | 300 | 70 | 140 | 20 | A7 |
| Sample 16 | 0.03 | 100 | 300 | 100 | 100 | 20 | A8 |

What is claimed is:

1. A method of manufacturing a protective textile comprising steps of:

(a) twisting a first yarn with a tungsten filament; and (b) covering the first yarn-tungsten generated in step (a) with a second yarn, and (c) twisting an elastic spandex with a yarn generated in step (b), and the tungsten is 60 to 80% and spandex is 20 to 40%, wherein a degree of twist is 400 to 700 twists/meter in step (a) and 120 to 280 twists/meter in step (b).

2. The method of manufacturing a protective textile of claim 1, wherein the tungsten filament is 35 to 75% and the first yarn is 25 to 65% in step (a).

3. The method of manufacturing a protective textile of claim 1, wherein the first yarn is selected from a group of Nylon, Polyethylene Terephthalate (PET), cotton yarn, bamboo fiber and Tencel, and a line density of the first yarn is 40 to 140D.

4. The method of manufacturing a protective textile of claim 3, wherein a line density of Nylon is selected from a group of 40D, 50D, 70D, 100D and 140D.

5. The method of manufacturing a protective textile of claim 1, wherein a diameter of the tungsten filament is selected from a group of 0.01 mm, 0.015 mm, 0.02 mm, 0.025 mm and 0.03 mm.

6. The method of manufacturing a protective textile of claim 1, wherein a Polyethylene (PE) fiber is the second yarn, and the tungsten filament is about 35 to 65% and PE fiber is about 35-65% in step (b).

7. The method of manufacturing a protective textile of claim 6, wherein a molecular weight of the PE fiber is 10 to 500W, and a line density of the protective textile is 50 to 400D.

8. The method of manufacturing a protective textile of claim 6, wherein a line density of the PE fiber is selected from a group of 50D, 100D, 150D, 200D, 300D and 400D.

9. The method of manufacturing a protective textile of claim 1, wherein the elastic spandex can be a third yarn covering a spandex, and the third yarn is selected from a group of Nylon, PET and PE.

10. The method of manufacturing a protective textile of claim 9, wherein the elastic spandex can be made by spandex with a line density of 20 to 100D and the third yarn with a line density of 50-200D, and the degree of twist is 180 to 580 twists/meter.

11. The method of manufacturing a protective textile of claim 10, wherein a tension ratio of the elastic spandex is 1.5 to 2.4.

* * * * *